US006514037B1

(12) United States Patent
Danowski et al.

(10) Patent No.: US 6,514,037 B1
(45) Date of Patent: Feb. 4, 2003

(54) METHOD FOR REDUCING COOLED TURBINE ELEMENT STRESS AND ELEMENT MADE THEREBY

(75) Inventors: Michael Joseph Danowski, Cincinnati, OH (US); Gulcharan Singh Brainch, West Chester, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/964,040

(22) Filed: Sep. 26, 2001

(51) Int. Cl.[7] ..... F01D 5/18
(52) U.S. Cl. ..... 415/115; 416/1; 416/97 R
(58) Field of Search ..... 415/1, 115, 116; 416/1, 96 R, 96 A, 97 R

(56) References Cited

U.S. PATENT DOCUMENTS

| | | | | |
|---|---|---|---|---|
| 3,628,885 A | | 12/1971 | Sidenstick et al. | |
| 4,153,386 A | * | 5/1979 | Leogrande et al. | 415/115 |
| 4,293,275 A | | 10/1981 | Kobayashi et al. | |
| 4,616,976 A | | 10/1986 | Lings et al. | |
| 4,786,233 A | | 11/1988 | Shizuya et al. | |
| 5,344,283 A | | 9/1994 | Magowan et al. | |
| 5,503,529 A | | 4/1996 | Anselmi et al. | |
| 5,975,851 A | | 11/1999 | Liang | |
| 6,065,928 A | | 5/2000 | Rieck, Jr. et al. | |
| 6,129,515 A | | 10/2000 | Soechting et al. | |
| 6,210,111 B1 | | 4/2001 | Liang | |
| 6,234,754 B1 | * | 5/2001 | Zelesky et al. | 416/97 R |
| 6,270,317 B1 | * | 8/2001 | Manning et al. | 416/97 R |
| 6,422,819 B1 | * | 7/2002 | Tsai et al. | 416/97 R |

* cited by examiner

*Primary Examiner*—Christopher Verdier
(74) *Attorney, Agent, or Firm*—Rodney M. Young; Sonnenschein Nath & Rosenthal

(57) ABSTRACT

A cooled turbine element including an airfoil and a flowpath boundary member extending laterally from either an inboard end or an outboard end of the airfoil. The member has a flowpath face and an outside face which is cooler than said flowpath face creating a tendency for the member to deflect in a direction away from the flowpath face and causing a thermally induced tensile radial stress in a region of the trailing edge of the airfoil. The element has an interior cooling passage and at least one cooling hole extending from the interior cooling passage to an opening located in an area upstream from the stressed region of the trailing edge to cool the area so the airfoil thermally deflects to a shape corresponding to that of the boundary member thereby lowering the thermally induced tensile radial stress in the airfoil at the trailing edge thereof.

14 Claims, 5 Drawing Sheets

METHOD FOR REDUCING COOLED TURBINE ELEMENT STRESS AND ELEMENT MADE THEREBY

BACKGROUND OF THE INVENTION

The present invention relates generally to cooled turbine elements for gas turbine engines, and more particularly, to a method of lowering a stress in a cooled turbine element and the element made thereby.

FIG. 1 illustrates a portion of a gas turbine engine, generally designated by the reference number 10. The gas turbine engine 10 includes cooled turbine elements such as a high pressure turbine nozzle 12, a high pressure turbine blade (generally designated by 14), and a first stage low pressure turbine nozzle 16. As illustrated in FIG. 2, each of these cooled elements (e.g., blade 14) includes one or more airfoils 20, and one or more flowpath boundary members (e.g., a blade platform, generally designated by 22). In the case of the turbine blade 14, the element also includes a conventional dovetail 24 for connecting the blade to a turbine disk 26 (FIG. 1), and a shank 28 extending between the dovetail and the blade platform 22. Interior cooling passages 30 extend from openings (not shown) at the inner end of the blade dovetail 24 to cooling holes 32 in the airfoil 20. The passages 30 convey cooling air through the blade to remove heat from the blade. The cooling air passing through the cooling holes 32 in the airfoil 20 provides a film cooling barrier around the exterior surface of the airfoil.

Each flowpath boundary member 22 has a flowpath face 34 which faces the flowpath of the engine 10 and an outside face 36 opposite the flowpath face. As will be appreciated by those skilled in the art, the flowpath face 34 of each flowpath boundary member 22 runs hotter than the outside face 36 during engine operation. This difference in temperature results in the flowpath face 34 tending to grow more as a result of thermal growth than the outside face 36. Because the boundary member 22 is constrained by the airfoil 20, the tendency for the flowpath face 34 to grow more than the outside face 36 produces thermal stresses in the boundary member and the airfoil. More particularly, tensile stresses are produced in a trailing edge 38 of the airfoil 20 due to the tendency for the flowpath face 34 to grow more than the outside face 36. Experience has shown that fatigue cracks form and propagate as a result of the tensile stresses in the trailing edge 38 of the airfoil 20, resulting in a shortened life of the blade 14. Thus, there is a need for a method of lowering these stresses in colled turbine elements.

SUMMARY OF THE INVENTION

Briefly, apparatus of this invention is a cool turbine element for use in a flowpath of a gas turbine engine. The element comprises an airfoil having a pressure side and a suction side opposite the pressure side. The pressure side and the suction side extend axially between a leading edge and a trailing edge opposite the leading edge and radially between an inboard end and an outboard end opposite the inboard end. Further, the element comprises a flowpath boundary member extending laterally from at least one of the inboard end and the outboard end. The boundary member has a flowpath face and an outside face opposite the flowpath face. The outside face runs cooler than the flowpath face during engine operation thereby creating a tendency for the member to deflect in a direction away from the flowpath face and causing a thermally induced tensile radial stress in a region of the trailing edge of the airfoil. In addition, the element comprises an interior cooling passage extending through the airfoil from a cooling air source for transporting cooling air through the airfoil and at least one cooling hole extending from the interior cooling passage to an opening located on one of the suction side and the pressure side in an area upstream from the stressed region of the trailing edge to cool the area to a temperature below that of the trailing edge so that the airfoil thermally deflects during engine operation to a shape corresponding to that of the flowpath boundary member thereby lowering the thermally induced tensile radial stress in the airfoil at the trailing edge thereof.

In another aspect, the invention includes a method of lowering a tensile stress at a trailing edge of an airfoil of a cooled blade adjacent a platform of the blade. The method comprises the step of forming at least one cooling hole in the airfoil from an interior cooling air passage to an exterior surface of the airfoil to deliver cooling air to the exterior surface to cool an area of the exterior surface immediately adjacent the cooling hole thereby shifting tensile thermal loading from regions of the airfoil adjacent the area of the exterior surface to the cooled area.

In yet another aspect, the present invention includes a method of lowering a thermal stress at a trailing edge of an airfoil of a cooled turbine blade adjacent a platform of the blade. The method comprises the step of forming at least one cooling hole positioned upstream from the trailing edge of the airfoil and extending from an interior cooling air passage to an exterior surface of the airfoil for delivering cooling air to the exterior surface to cool the airfoil in an area of the exterior surface upstream from the trailing edge so that a thermal deflection of the airfoil more closely corresponds to a thermal deflection of the platform thereby lowering thermally induced stresses in the airfoil at the trailing edge thereof.

Other features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
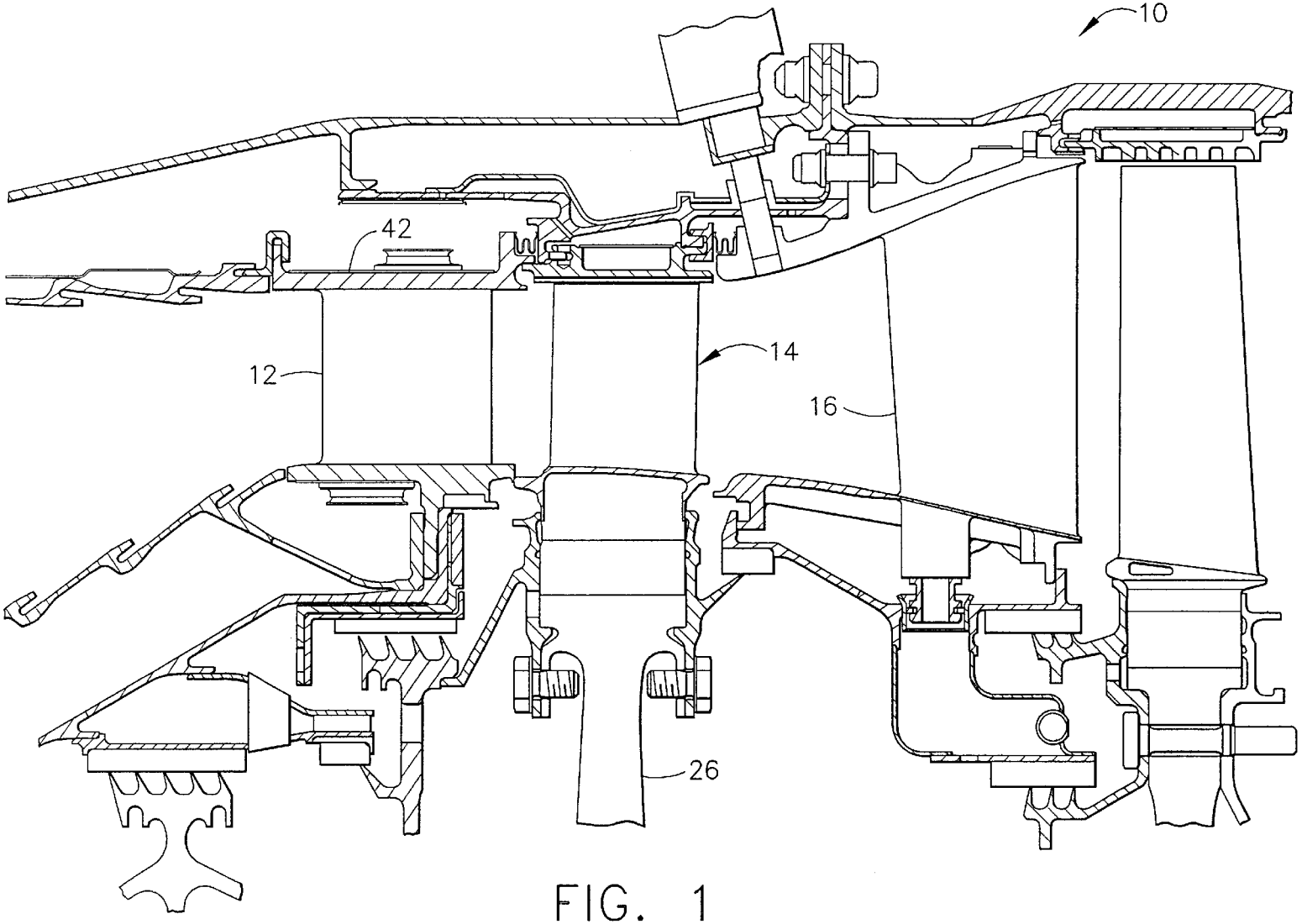
FIG. 1 is a vertical cross section of a portion of a gas turbine engine showing a cooled turbine blade.
Figure 3:
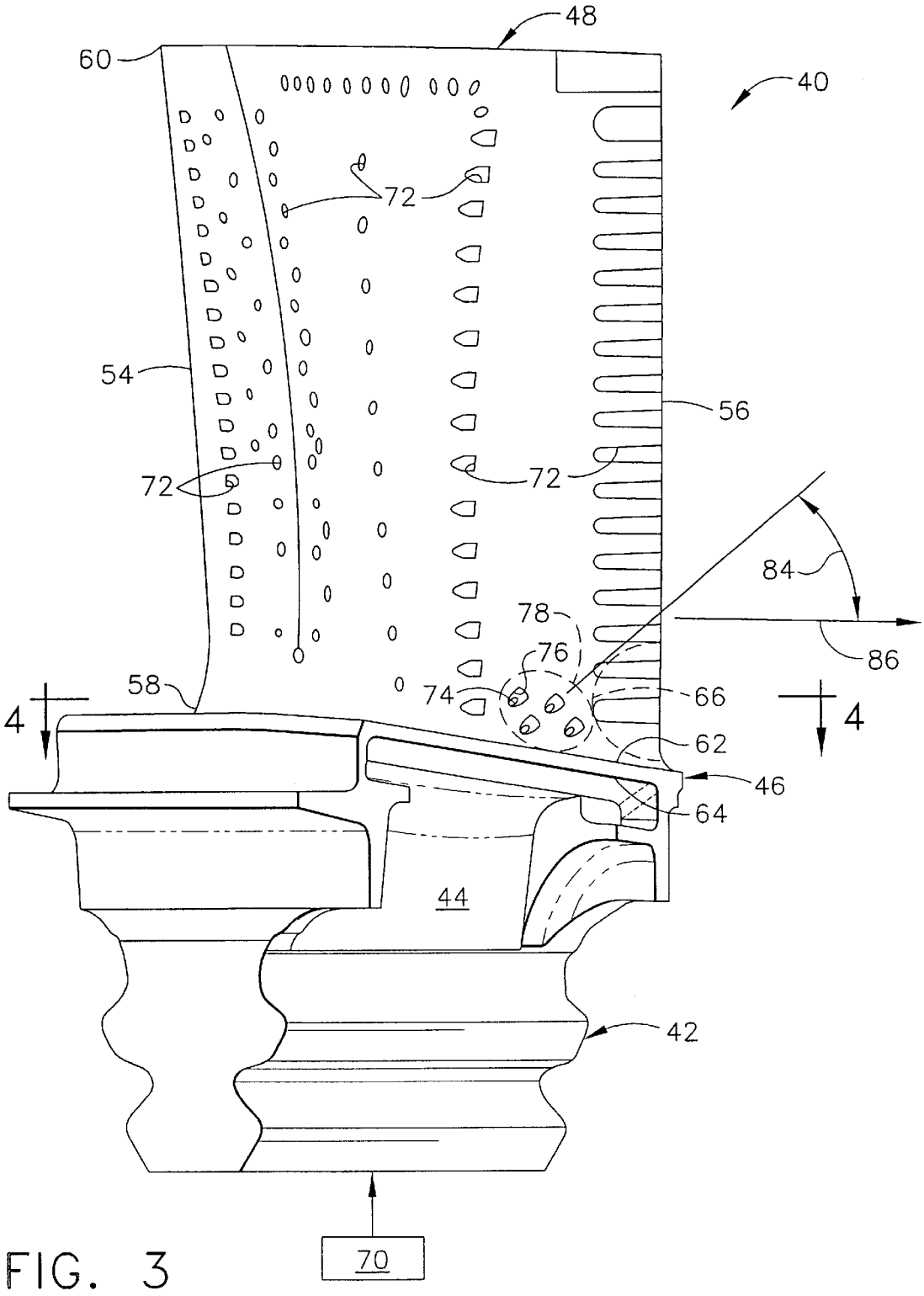
FIG. 3 is a perspective of a cooled turbine blade of the present invention.

Referring now to the drawings and in particular to FIG. 3, an air cooled gas turbine engine blade of the present invention is designated in its entirety by the reference number 40. The blade 40 includes a conventional dovetail, generally designated 42, sized and shaped for receipt in a complimentary slot in a disk 26 (FIG. 1) of a gas turbine engine 10 (FIG. 1) for retaining the blade in the disk. A shank 44 extends outward (relative to a centerline of the engine) from the dovetail 42 to a platform or flowpath boundary member, generally designated by 46, which forms an inner flowpath surface of the engine. An airfoil, generally designated by 48, extends outward from the platform 46.

Figure 4:
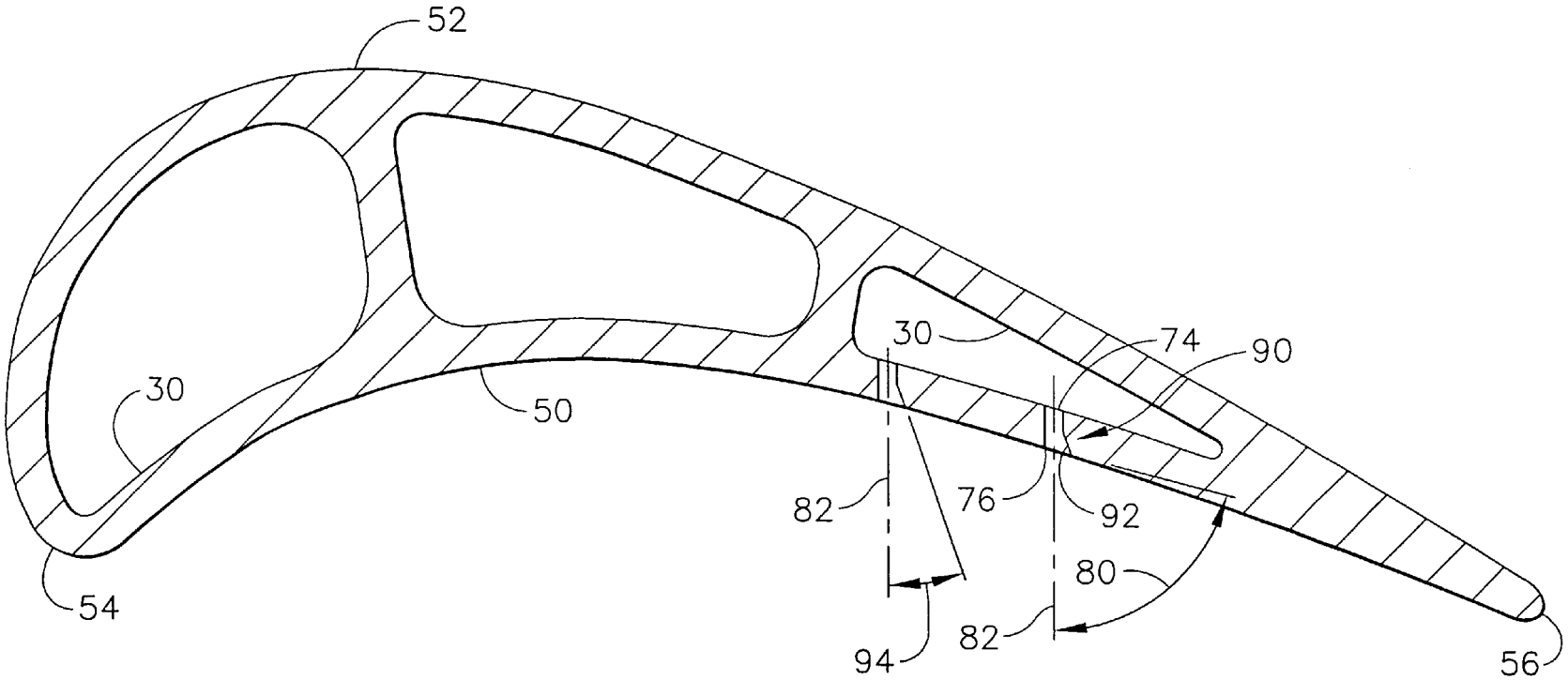
FIG. 4 is a cross section of the blade taken in the plane of line 4—4 of FIG. 3.

As illustrated in FIG. 4, the airfoil 48 has a pressure side 50 and a suction side 52 opposite the pressure side. The pressure side 50 and the suction side 52 extend axially between a leading edge 54 and a trailing edge 56 opposite the leading edge and radially between an inboard end 58 (FIG. 3) and an outboard end 60 (FIG. 3) opposite the inboard end. The platform 46 extends laterally from the inboard end 58 of the airfoil 48. As illustrated in FIG. 3, the platform 46 has a flowpath face 62 and an outside face 64 opposite the flowpath face. The outside face 64 runs cooler than the flowpath face 62 during engine operation. As will be appreciated by those skilled in the art, this temperature difference causes the flowpath face 62 to expand more than the outside face 64 which creates a tendency for the platform 46 to deflect in a direction away from the flowpath face, causing a thermally induced tensile radial stress in a region, generally designated by 66, of the trailing edge 56 of the airfoil 48.

Figure 2:
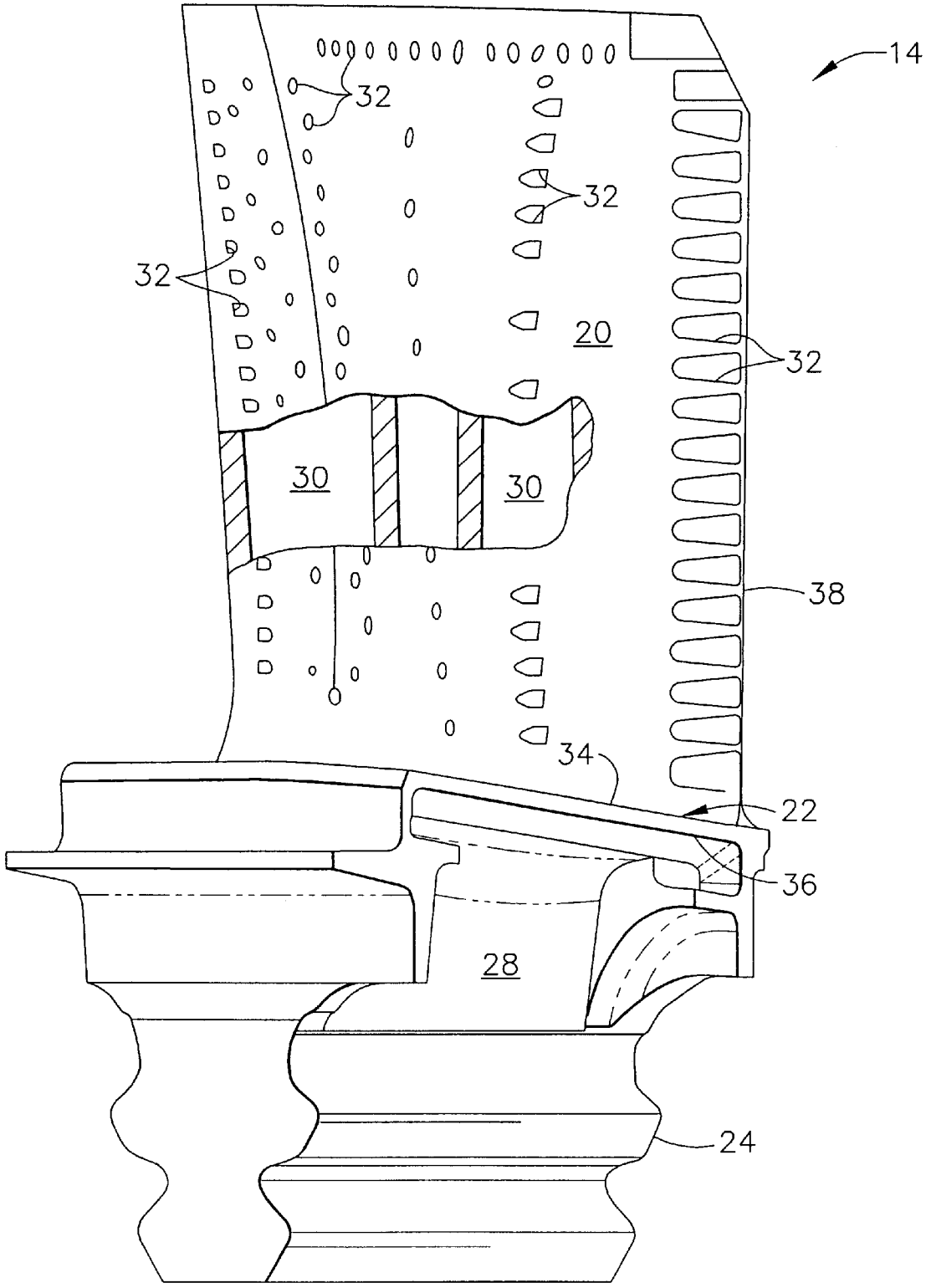
FIG. 2 (PRIOR ART)
FIG. 2 is a perspective of a prior art cooled turbine blade in partial section.

An interior cooling passage 30 (FIG. 2) extends through the airfoil 48 from a cooling air source 70 (e.g., a compressor bleed port shown schematically in FIG. 3) for transporting cooling air through the airfoil. As further illustrated in FIG. 3, the airfoil 48 includes a plurality of conventionally positioned cooling air holes 72 which distribute cooling air over the surface of the airfoil to thermally insulate the airfoil from flowpath gases. In addition to the conventionally positioned cooling holes 72, the airfoil 48 includes one or more cooling holes 74 extending from the interior cooling passage 30 to openings 76 (FIG. 4) located in an area, generally designated 78, upstream from the stressed region 66 of the trailing edge 56. The cooling holes 74 deliver cooling air to the area 78 to cool it to a temperature below that of the trailing edge 56. The number, position, size and shape of the cooling holes 74 are selected so that the airfoil 48 thermally deflects during engine operation to a shape corresponding to the deflected shape of the platform 46. Further, the number, position, size and shape of the cooling holes 74 are selected so that the thermal deflection of the airfoil 48 more closely corresponds to the thermal deflection of the platform than it would if the cooling holes 74 were not present. Because the airfoil 48 deflection matches the platform 46 deflection, the thermally induced tensile radial stress at the trailing edge 56 of the airfoil is reduced. In contrast to the cooling holes 74 of the present invention, the number, position, size and shape of prior cooling holes 72 were selected to deliver cooling air to specific locations on the airfoil to improve cooling at those locations, to improve aerodynamic flows around the airfoils and/or to provide a boundary of film cooling air over portions of the airfoil.

Although the cooling holes 74 may be positioned on other sides of the airfoil 48 without departing from the scope of the present invention, in one embodiment the cooling holes are positioned on the pressure side 50 of the airfoil. Although the cooling holes 74 may extend through the airfoil 48 at other angles without departing from the scope of the present invention, in one embodiment each of the cooling holes extends at an angle 80 of between about twenty degrees and about forty degrees measured from a centerline 82 of the cooling hole to the pressure side of the airfoil as shown in FIG. 4. Further, although the cooling holes 74 may be positioned in other areas without departing from the scope of the present invention, in one embodiment each of the cooling holes extends to openings 76 located on the airfoil 48 between about 65 percent chord and about 85 percent chord and between about zero percent span and about ten percent span. More particularly, in the one embodiment each of the cooling holes 74 extends to openings 76 located on the airfoil 48 between about seventy percent chord and about 83 percent chord and between about four percent span and about six percent span. Still further, although the cooling holes 74 may extend in other directions without departing from the scope of the present invention, in one embodiment each of the cooling holes extends radially outward at an angle 84 of between about zero degrees and about ninety degrees with respect to an axial direction 86 of the engine 10 as illustrated in FIG. 3. More particularly, in the one embodiment each of the cooling holes 74 extends radially outward at an angle 84 of about 34 degrees with respect to the axial direction 86 of the engine 10. Although the airfoil 48 may have fewer or more cooling holes 74 without departing from the scope of the present invention, in one embodiment the airfoil has four cooling holes.

More particularly, in the one embodiment each of the cooling holes 74 extends to openings 76 located on the airfoil 48 between about seventy percent chord and about 83 percent chord and between about four percent span and about six percent span. Still further, although the cooling holes 74 may extend in other directions without departing from the scope of the present invention, in one embodiment each of the cooling holes extends radially outward at an angle 84 of between about zero degrees and about ninety degrees with respect to an axial direction 86 of the engine 10 as illustrated in FIG. 3. More particularly, in the one embodiment each of the cooling holes 74 extends radially outward at an angle 84 of about 34 degrees with respect to the axial direction 86 of the engine 10. Although the airfoil 48 may gave fewer or more cooling holes 74 without departing from the scope of the present invention, in one embodiment the airfoil has four cooling holes.

Figure 5:
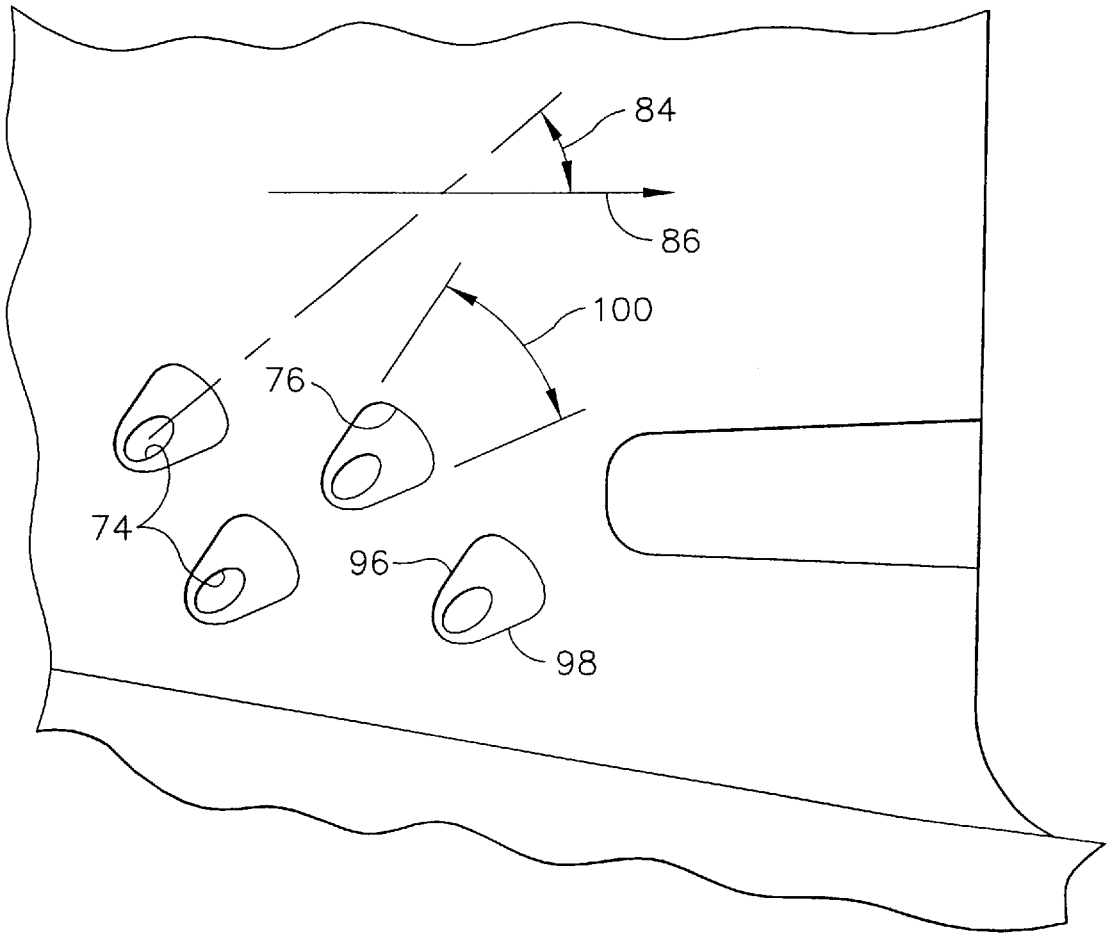
FIG. 5 is a detail of the blade of FIG. 3.

Moreover, although the cooling holes 74 may have other shapes without departing from the scope of the present invention, in one embodiment the cooling holes are generally cylindrical and include diffuser sections, generally designated by 90, having diverging sides as illustrated in FIG. 4. Although the diffuser sections 90 may have other shapes without departing from the scope of the present invention, in one embodiment the diffuser section has an aft side 92 which diverges from the centerline 82 of the respective cooling hole at an angle 94 of between about zero degrees and about twenty degrees as shown in FIG. 4. As illustrated in FIG. 5, the diffuser section of this one embodiment has an outer side 96 and an inner side 98 which diverge with respect to one another at an angle 100 of between about zero degrees and about fifty degrees. It is envisioned that the blade 40, and more particularly the airfoil 48 and cooling holes 74, may be formed using conventional methods.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A method of lowering a thermal stress at a trailing edge of an airfoil of a cooled turbine blade adjacent a platform of the blade, said method comprising the step of forming at least one cooling hole positioned upstream from the trailing edge of the airfoil and extending from an interior cooling air passage to an exterior surface of the airfoil for delivering cooling air to the exterior surface to cool the airfoil in an area of the exterior surface upstream from the trailing edge so that a thermal deflection of the airfoil more closely corresponds to a thermal deflection of the platform thereby lowering thermally induced stresses in the airfoil at the trailing edge thereof.

2. A method as set forth in claim 1 wherein said at least one cooling hole is formed on a pressure side of the airfoil so that the thermal deflection of the airfoil more closely corresponds to the thermal deflection of the platform to lower thermally induced bending stresses in the airfoil at the trailing edge thereof.

3. A cooled turbine element for use in a flowpath of a gas turbine engine comprising:

an airfoil having a pressure side and a suction side opposite said pressure side, said pressure side and said suction side extending axially between a leading edge and a trailing edge opposite said leading edge and radially between an inboard end and an outboard end opposite said inboard end;

a flowpath boundary member extending laterally from at least one of said inboard end and said outboard end, said boundary member having a flowpath face and an outside face opposite the flowpath face, said outside face running cooler than said flowpath face during engine operation thereby creating a tendency for the member to deflect in a direction away from the flowpath face and causing a thermally induced tensile radial stress in a region of the trailing edge of the airfoil;

an interior cooling passage extending through the airfoil from a cooling air source for transporting cooling air through the airfoil; and at least one cooling hole extending from the interior cooling passage to an opening located on one of said suction side and said pressure side in an area upstream from the stressed region of said trailing edge to cool said area to a temperature below that of the trailing edge so that the airfoil thermally deflects during engine operation to a shape corresponding to that of the flowpath boundary member thereby lowering the thermally induced tensile radial stress in the airfoil at the trailing edge thereof.

4. An element as set forth in claim 1 wherein the element is a cooled turbine blade and the lateral boundary member is a platform thereof positioned at the inboard end of the airfoil.

5. An element as set forth in claim 1 wherein the cooling hole extends to said pressure side of the airfoil.

6. An element as set forth in claim 5 wherein the cooling hole extends at an angle of between about twenty degrees and about forty degrees with respect to said pressure side of the airfoil.

7. An element as set forth in claim 1 wherein the position to which the cooling hole extends is located on the airfoil between about 65 percent chord and about 85 percent chord.

8. An element as set forth in claim 7 wherein the position to which the cooling hole extends is located on the airfoil between about seventy percent chord and about 83 percent chord.

9. An element as set forth in claim 1 wherein the position to which the cooling hole extends is located on the airfoil between about zero percent span and about ten percent span.

10. An element as set forth in claim 9 wherein the position to which the cooling hole extends is located on the airfoil between about four percent span and about six percent span.

11. An element as set forth in claim 1 wherein the cooling hole extends radially outward at an angle of between about zero degrees and about ninety degrees with respect to an axial direction of the engine.

12. An element as set forth in claim 1 wherein the cooling hole diverges from the interior cooling passage to the position.

13. An element as set forth in claim 12 wherein the cooling hole diverges at an angle of between about zero degrees and about twenty degrees.

14. An element as set forth in claim 1 wherein the element has four cooling holes extending from the interior cooling passage to positions located in the area to cool said area to a temperature below that of the trailing edge so that the airfoil thermally deflects during engine operation to a shape corresponding to that of the flowpath boundary member thereby lowering the thermally induced tensile radial stress in the airfoil at the trailing edge thereof.

* * * * *

UNITED STATES PATENT AND TRADEMARK OFFICE

CERTIFICATE OF CORRECTION

PATENT NO. : 6,514,037 B1
DATED : February 4, 2003
INVENTOR(S) : Danowski et al.

It is certified that error appears in the above-identified patent and that said Letters Patent is hereby corrected as shown below:

Column 6,
Lines 3, 7, 13, 20, 26, 30 and 36, replace “1” with -- 3 --.

Signed and Sealed this

Eighteenth Day of May, 2004

JON W. DUDAS
*Acting Director of the United States Patent and Trademark Office*